US005660015A

United States Patent [19]

Kluser

[11] Patent Number: 5,660,015

[45] Date of Patent: Aug. 26, 1997

[54] DEVICE FOR SECURING INSULATION MATERIAL

[75] Inventor: Remo Kluser, Alstätten, Switzerland

[73] Assignee: Hilti Aktiengesellschaft, Schaan, Liechtenstein

[21] Appl. No.: 601,901

[22] Filed: Feb. 15, 1996

[30] Foreign Application Priority Data

Feb. 15, 1995 [DE] Germany ..... 195 04 984.5

[51] Int. Cl.[6] ..... E04D 5/14

[52] U.S. Cl. ..... 52/410; 411/392; 411/508

[58] Field of Search ..... 52/410; 411/392, 411/508, 431, 928, 970, 377, 903, 258

[56] References Cited

U.S. PATENT DOCUMENTS 4,834,600 5/1989 Lemke ..... 52/410 X
4,881,861 11/1989 Henwison ..... 52/410 X
4,932,819 6/1990 Almeras ..... 52/410 X
4,987,714 1/1991 Lemke ..... 52/410
5,054,983 10/1991 Froenis et al. ..... 52/410 X
5,171,118 12/1992 Rothenbühler ..... 52/410 X
5,177,922 1/1993 Ovaert et al. ..... 52/410
5,265,998 11/1993 Kluser ..... 52/410 X

*Primary Examiner*—Carl D. Friedman
*Assistant Examiner*—Yvonne Horton Richardson
*Attorney, Agent, or Firm*—Anderson Kill & Olick P.C.

[57] ABSTRACT

A device for securing insulation material (7) to a base material (8) includes a receptacle (1) fixable to the base material and a large area head (2) arranged to abut against the insulation material with flexible elastic retaining strips (3, 4) extending from the receptacle to the head. Each strip has a sawtooth-like profiled surface (5, 6). The head (2) has through aperture (9, 10) for receiving the strips (3, 4) with locking members in the through aperture with profiled surfaces similar to the profiled surfaces on the strips arranged to provide an interlock between the head (2) and the retaining strips (3, 4).

7 Claims, 2 Drawing Sheets

DEVICE FOR SECURING INSULATION MATERIAL

BACKGROUND OF THE INVENTION

The present invention is directed to a device for securing insulation material to a base material by means of a receptacle fastenable to the base material and a large area-head bearing against the surface of the insulation material spaced outwardly from the base material.

A device for securing plate-shaped insulation material of different thicknesses to flat roofs is disclosed in DE-OS 34 18 028. This device is made up of a large area head and a receptacle fastened by a threaded connection to a component of the roof. The large area head is connected by a shaft projecting into a receiving bore in the receptacle and forms a single piece with the head. A positively locked connection of the large area head with the receptacle is gained by profiled surfaces on the shaft and in the receiving bore of the receptacle.

In locations where high temperature differences occur, changes in the dimensions of the insulation material take place in the form of extensive lateral displacements. Since a displacement of the large area head bearing against the surface of the insulation material relative to the receptacle fastened to the roof component is not possible in a direction extending parallel to the surface of the insulation material, accordingly, this known device cannot be used.

SUMMARY OF THE INVENTION

Therefore, the primary object of the present invention is to provide a device for securing insulation material which can be simply and economically secured to base materials and assures a secure fastening of the insulation material at the surface of the base material, even where large lateral displacement of the insulation material occurs due to large temperature differences.

In accordance with the present invention, at least one flexible elastic retaining strip extends between the receptacle and the head.

By using a flexible elastic retaining strip, a displacement of the large area head bearing on the surface of the insulation material spaced from the receptacle and extending parallel to the surface of the insulation material is possible. The contact pressure force applied by the device on the insulation material is maintained even during sidewise displacement of the large area head.

Preferably, the retaining strip and the receptacle are formed as a single piece for economic and manufacturing reasons. The retaining strip projects from the trailing end face of the receptacle, spaced from the leading end in contact with the base material.

The large area head can be displaced in the direction of the receptacle relative to the retaining strip for securing the insulation material of different thicknesses. To afford, as far as possible, central engagement of the retaining strip of the large area head, the head has at least one through aperture for securing the trailing end of the retaining strip spaced outwardly from the receptacle in a mechanically locked connection.

Saw-tooth like profiled surfaces on the flexible elastic retaining strip cooperate with similar surfaces in the through aperture for effecting a simple and economic mechanically locked connection of the strip with the through aperture of the large area head.

For displacing the large area head along the retaining strip in the direction of the receptacle and for preventing a self-induced displacement of the head in the opposite direction, the flanks of the sawtooth-like profiled surfaces facing the receptacle are preferably formed at right angles to the axial or longitudinal extent of the strip with the flanks extending away from the receptacle tapering in the direction of the trailing end of the retaining strip.

The contact pressure force acting on the insulation material depends upon the force pressing the large area head against the insulation material with simultaneous displacement relative to the retaining strip. Higher contact pressure forces cause high tension forces in the retaining strip. Devices formed of several, preferably two, retaining strips extending parallel to one another and disposed diametrically opposite one another, can absorb higher tensile forces. The tensile forces developed are distributed uniformly between the two retaining strips.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
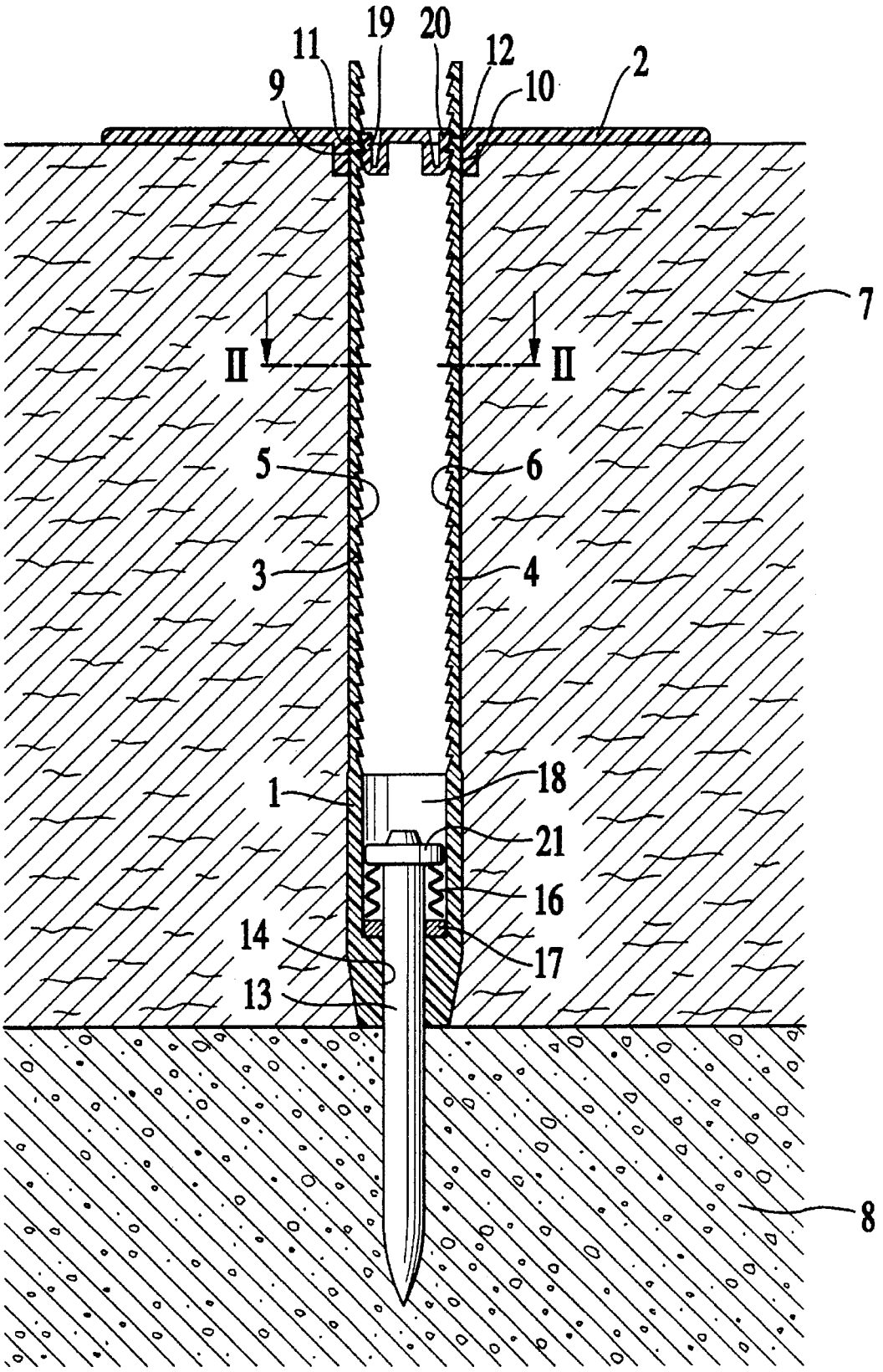
FIG. 1 is an axially extending sectional view of a device embodying the present invention.
Figure 2:
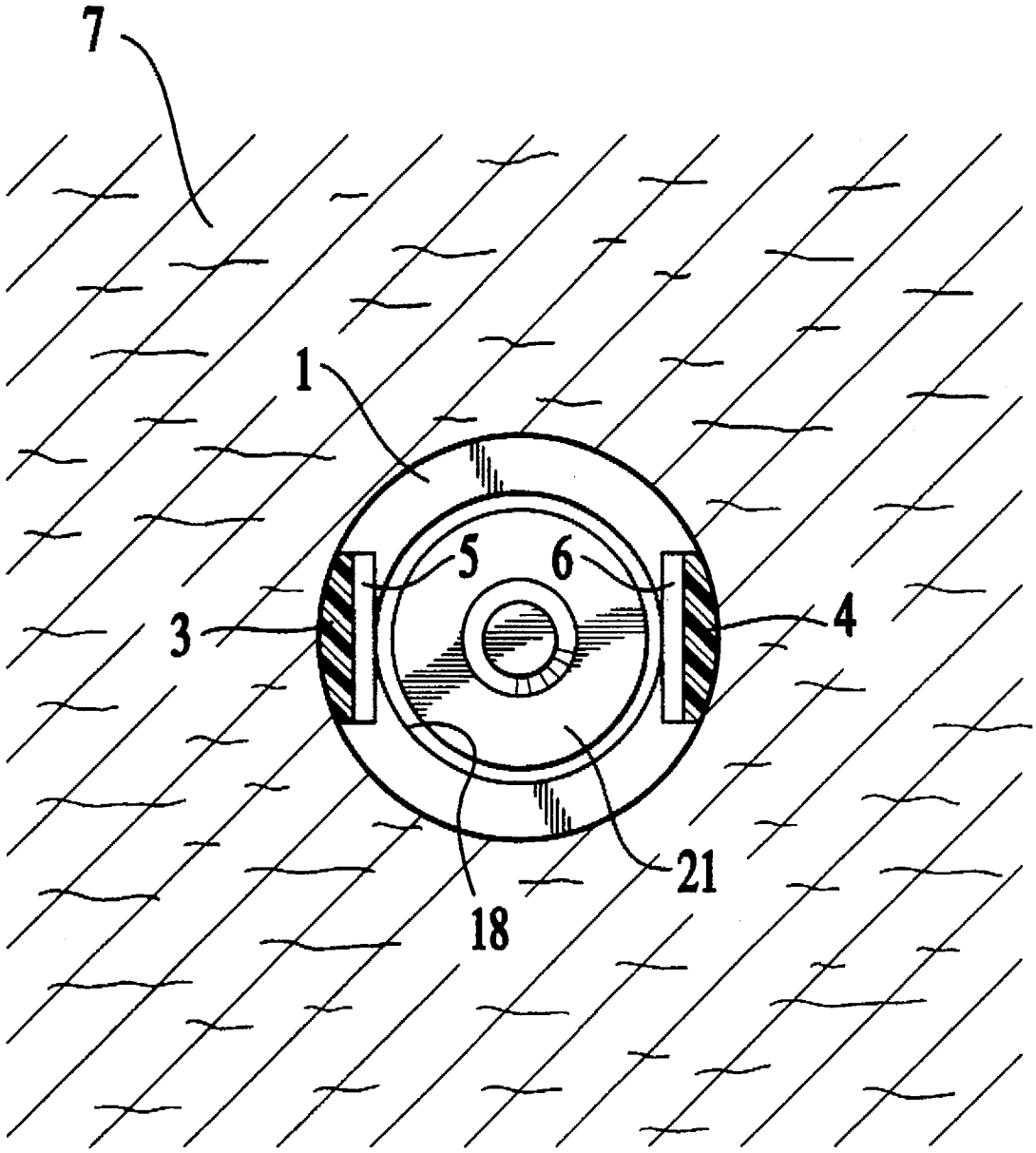
FIG. 2 is an enlarged sectional view through the device taken along the line II—II in FIG. 1.

In the drawing, a device for securing insulation material 7 to the surface of a base material 8 is illustrated and is formed of a receptacle 1, a large area head 2 as compared to the transverse cross section of the receptacle, two flexible retaining strips 3, 4 and a fastening element 13 securing the receptacle to the base material. The receptacle 1 is an axially extending member having a leading end secured to a surface of the base material 8 by the fastening element 13. The fastening element is guided in a centrally arranged axially extending bore 14 extending from the leading end of the receptacle towards its trailing end. A laterally enlarged head 21 on the fastening element 13 abuts against an axially deformable member 16. The deformable element 16 is contacted by the head 21 at its trailing end and, in turn, presses against a disc 17 located at a transition surface between the trailing end of the bore 14 and a radially widened receiving bore 18 extending to the trailing end of the receptacle 1. The diameter of the fastening element 13 corresponds essentially to the diameter of the bore 14.

Two axially or longitudinally extending flexible elastic retaining strips 3,4 formed integrally with the receptable extend parallel to one another and are spaced laterally apart extending from the trailing end of the receptable towards the surface of the insulation material 7 spaced outwardly from the base material 8. Each of the retaining strips 3, 4 has an axially extending sawtooth-like profiled surface 5, 6 on the surfaces facing one another with the teeth formed along the axially extending surfaces. The teeth forming the profiled surfaces 5, 6 are formed of first flanks 5*a*, 6*a* facing the receptacle 1 and extending at a 90° angle to the axial extent of the retaining strips 3, 4 with the second flanks 5*b*, 6*b* tapering outwardly, that is, away from one another, toward the trailing end of the retaining strips.

The large area head 2 has two through apertures 9, 10 each arranged to receive one of the retaining strips 3, 4. Each aperture 9, 10 has a pivotally displaceable locking element 19, 20 and each locking element is a sawtooth-like profiled surfaces 11, 12 on the side facing the profiled surfaces 5, 6 of the retaining strips 3, 4.

When securing the device of the present invention to the base material 8, the receptacle 1 is inserted into the mouthpiece of the guide tube of a fastening element setting tool, not shown. A guide tube is used with an external diameter matched to the internal diameter of the bore 18 in the receptacle. A fastening element 13 located in the guide tube is driven into the base material by the force of an explosive powder charge. The laterally enlarged head 21 on the fastening element 13, having a diameter corresponding basically to the diameter of the bore 18, guides the fastening element 13 through the bore 14 in the leading end region of the receptacle and then into the base material 8. The axially deformable element 16 located between the head 21 of the fastening element 13 is axially upset and presses the receptacle, with the interposition of the disc 17, against the surface of the base material 8. Subsequently, the large area head 2 having an outside diameter much larger than the outside diameter of the receptacle 1, is displaced along the retaining strips 3, 4 in the direction of the receptacle until it bears against the surface of the insulating material 7 located outwardly from the base material. During the displacement of the large area head 2 the trailing or outer ends of the retaining strips 3, 4 are grasped with one hand and the retaining strips are tightened. After the head 2 is secured against the surface of the insulation material, the outwardly projecting ends of the retaining strips 3, 4, extending outwardly from the head 2, are cut off.

While specific embodiments of the invention have been shown and described in detail to illustrate the inventive principles, it will be understood that the invention may be embodied otherwise without departing from such principles.

I claim:

1. Device for securing insulation material (7) to a base material (8) comprises an axially extending receptacle (1) having a leading end and a trailing end relative to the base material, means for fixing the leading end of said receptacle to the base material (8), a large area head (2) as compared to the transverse section of said receptacle being arranged to abut against a surface of the insulation material spaced outwardly from said receptacle and the base material, and at least one flexible elastic retaining strip (3, 4) extending outwardly from the trailing end of the receptacle and arranged to engage said head (2) in a mechanically locked connection, and said head being laterally displaceable relative the axis of said receptacle due to the flexibility of said elastic retaining strip.

2. Device, as set forth in claim 1, wherein said retaining strip (3, 4) and said receptacle are formed integrally as a single piece.

3. Device, as set forth in claim 1 or 2 wherein said head (2) having at least one through aperture (9, 10) extending in the axial direction of said receptacle (1) and serving for receiving and the mechanically locked connection with a trailing end of said retaining strip (3, 4) spaced outwardly from the trailing end of said receptacle (1).

4. Device, as set forth in claim 3, wherein said retaining strip (3, 4) has a sawtooth-like profiled surface (5, 6) extending axially outwardly from said receptacle (1), and said through-aperture (9, 10) in said head having a similarly shaped profiled surface (11, 12) for effecting the mechanically locked connection between said retaining strip and said head.

5. Device, as set forth in claim 4, wherein said sawtooth-like profiled surfaces (5, 6) having first flanks facing said receptacle (1) extending at right angles to the axial direction of said receptacle and second flanks extending outwardly from said first flanks away from said receptacle (1) and tapering outwardly from the axis of said receptacle (1).

6. Device, as set forth in claim 1 or 2, wherein said device comprises two said retaining strips (3, 4) extending parallel to one another and located diametrically opposite one another relative to the axis of said receptacle.

7. Device, as set forth in claim 6, wherein said retaining strips each have a sawtooth-like profiled surface (5, 6) facing one another.

* * * * *